US005275138A

United States Patent [19]

Hotta et al.

[11] Patent Number: 5,275,138

[45] Date of Patent: Jan. 4, 1994

[54] VARIABLE VALVE TIMING SYSTEM IN AN ENGINE HAVING TWO CAM-SHAFTS

[75] Inventors: Koji Hotta, Aichi; Kongo Aoki, Toyota, both of Japan

[73] Assignee: Aisin Seiki Kabushiki Kaisha, Kariya, Japan

[21] Appl. No.: 10,843

[22] Filed: Jan. 29, 1993

[30] Foreign Application Priority Data

Jan. 31, 1992 [JP] Japan ..... 4-016468

[51] Int. Cl.[5] ..... F01L 1/34

[52] U.S. Cl. ..... 123/90.17; 123/90.31; 464/2

[58] Field of Search ..... 123/90.15, 90.17, 90.31; 464/1, 2, 160

[56] References Cited

U.S. PATENT DOCUMENTS

| | | | |
|---|---|---|---|
| 4,841,924 | 6/1989 | Hampton et al. | 123/90.17 |
| 4,993,370 | 2/1991 | Hashiyama et al. | 123/90.17 |
| 5,067,450 | 11/1991 | Kano et al. | 123/90.17 |
| 5,181,484 | 1/1993 | Kan et al. | 123/90.17 |
| 5,181,485 | 1/1993 | Hirose et al. | 123/90.31 |
| 5,215,046 | 6/1993 | Takenaka et al. | 123/90.17 |

FOREIGN PATENT DOCUMENTS

| | | | |
|---|---|---|---|
| 209907 | 7/1992 | Japan | 123/90.17 |

*Primary Examiner*—Tony M. Argenbright
*Assistant Examiner*—Weilun Lo
*Attorney, Agent, or Firm*—Oblon, Spivak, McClelland, Maier & Neustadt

[57] ABSTRACT

For minimizing a diameter of an apparatus which is located on the cam-shaft and changes a phase between two cam-shafts, a variable valve timing system in an engine having first and second cam-shafts is comprised of a first gear rotatably supported on the first cam-shaft, a second gear fixed to the second cam-shaft, and geared with the first gear to transmit torque to the second cam-shaft, a first device for transmitting torque from the first cam-shaft to the first gear, and for rotating the first gear toward a first position, the first device being located on one end of the first cam-shaft, and a second means for rotating the first gear in a second direction opposite the first direction, toward a second position, the second device being located on one end of the second cam-shaft.

4 Claims, 4 Drawing Sheets

VARIABLE VALVE TIMING SYSTEM IN AN ENGINE HAVING TWO CAM-SHAFTS

BACKGROUND OF THE INVENTION

1. Field of the Invention

The present invention relates to a variable valve timing system in an engine having two cam-shafts and in particular to a variable valve timing system to vary the valve timing of intake and exhaust valves.

2. Description of the Related Art

A conventional variable valve timing system 100, as shown in FIG. 5, is disclosed in the U.S. Pat. No. 5,067,450. The system 100 is used for an engine (not shown) having two cam-shafts (only one is shown). An apparatus 101 is located on one end of the cam-shaft 102 and comprises outer teeth 103. The outer teeth 103 are geared with outer teeth (not shown) of a pulley (not shown) which is fixed to the other cam-shaft.

A rotating torque of the cam-shaft 102 is transmitted to the other cam-shaft via a case 110, a cylindrical piston 111, a pulley 112 and the not-shown pulley. There are backlash in a geared portion 121 between the case 110 and the piston 111, geared portion 122 between the piston 111 and pulley 112 and geared portion 123 between the pulley 112 and not-shown pulley. In general, a backlash is a cause of a noise since two geared teeth hit each other.

The system 100 comprises an apparatus 130 to decrease the noise. That is, labyrinth groove portion 131 is formed between the case 110 and the pulley 112 and is covered by a cover 132 to fill an oil therearound. Therefore, a movement which is generated when two geared teeth is damped by the aperture 130 and force of the impact is softened.

However, in order to accommodate the apparatus 130, it is necessary to provide the pulley 112 with a large diameter. As a result, a space between two cam-shafts is enlarged and the engine is also enlarged.

SUMMARY OF THE INVENTION

Accordingly, it is an object of the present invention to reduce a diameter of an apparatus, which is located on one end of the cam-shaft, for changing a phase between two cam-shafts.

It is another object of the present invention to make substantially prevent all backlashes between the gear teeth of the apparatus.

The above and other objects are achieved according to the present invention by a variable valve timing system which comprises a first gear supported on the cam-shaft rotatably, a second gear fixed to the other cam-shaft, and geared with the first gear, first means for transmitting torque from the cam-shaft to the first gear, and for rotating the cam-shaft and the first gear relatively to first direction, the first means being located on one end of the cam-shaft, and second means for rotating the cam-shaft and the first gear relatively to second direction, the second means being located on one end of the other cam-shaft.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawing, wherein.

DETAILED DESCRIPTION OF THE INVENTION

Figure 1:
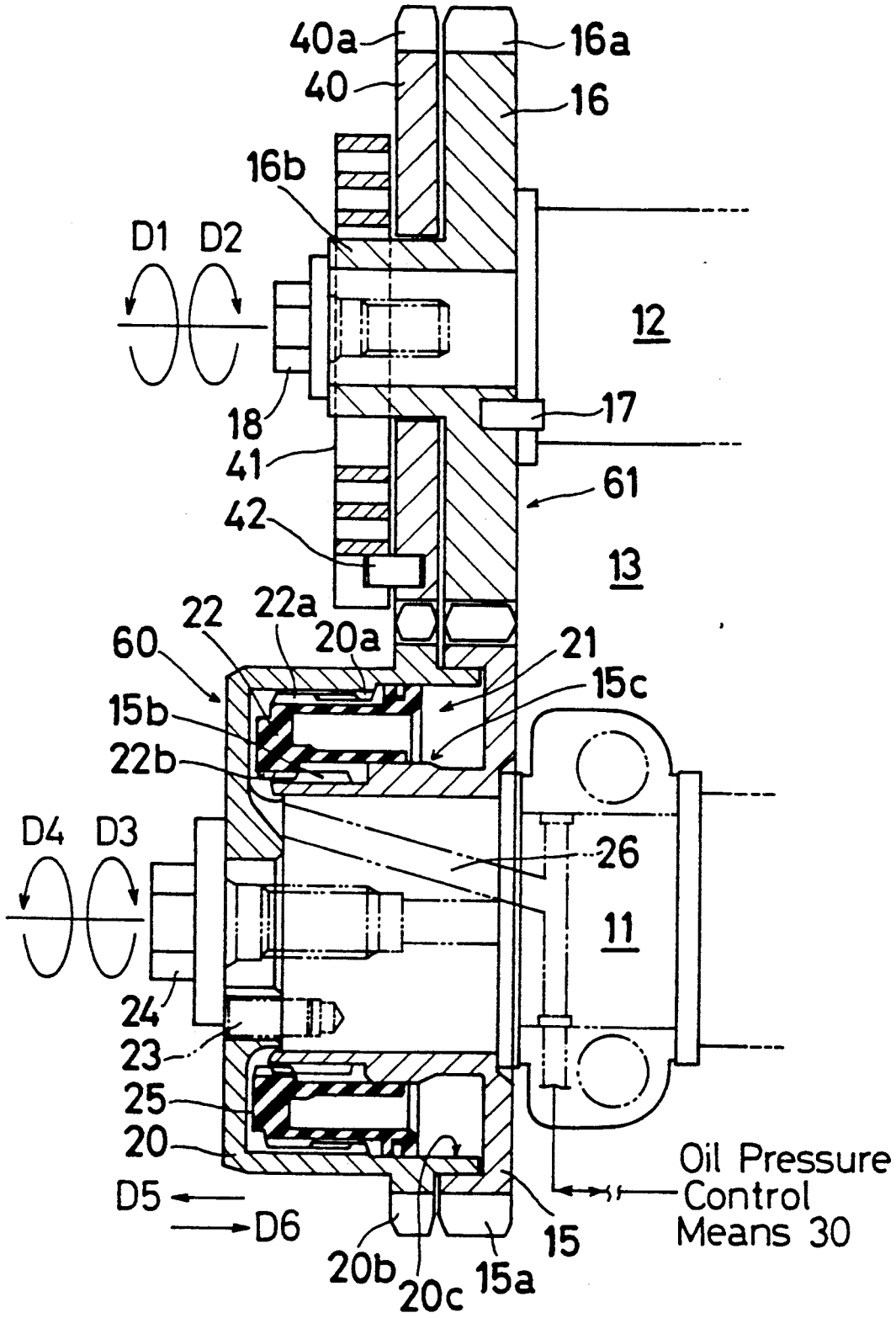
FIG. 1 is a cross-sectional view of a variable valve timing system according to the embodiment of the invention.
Figure 2:
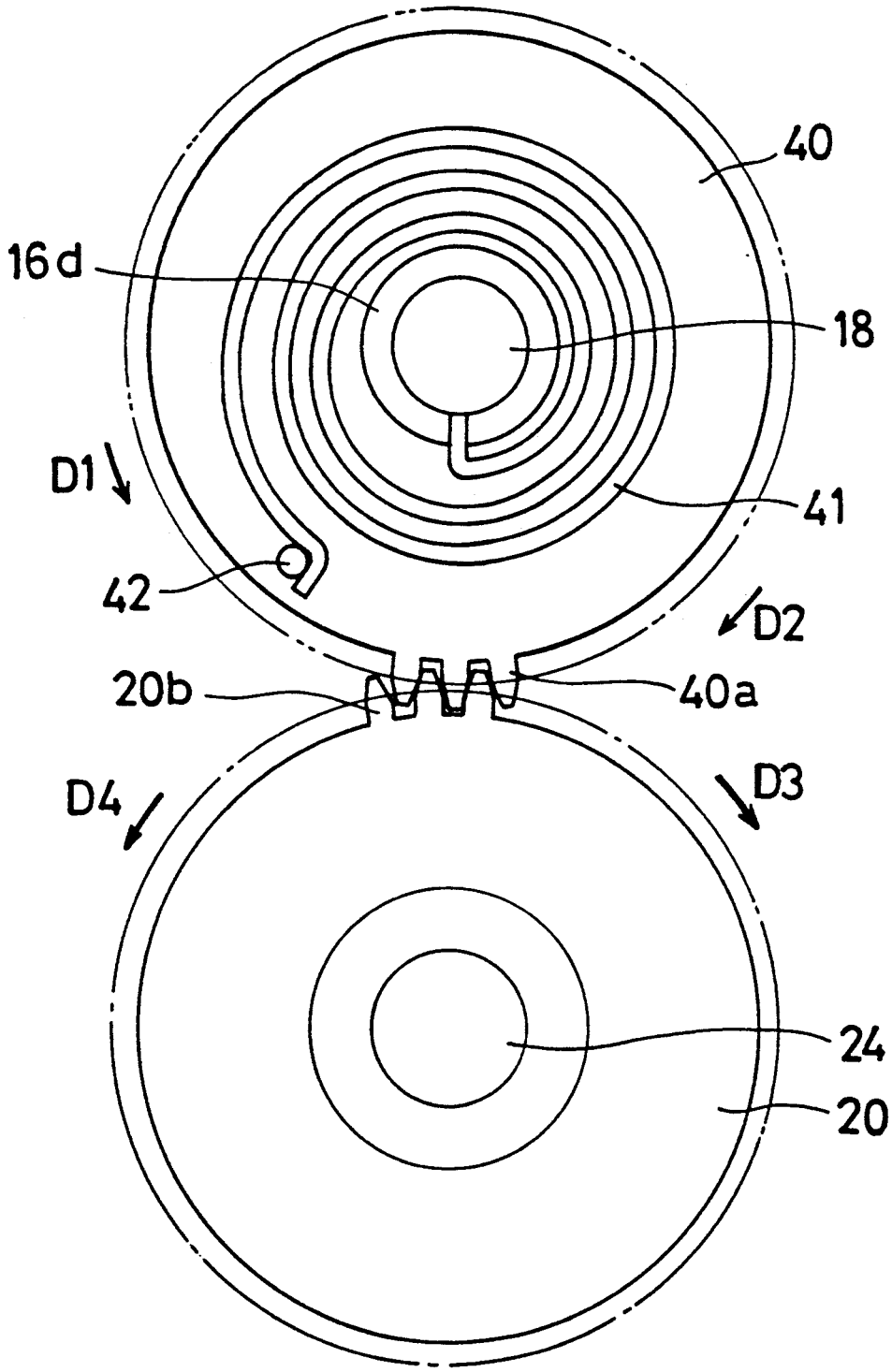
FIG. 2 is a front view of FIG. 1.
Figure 3:
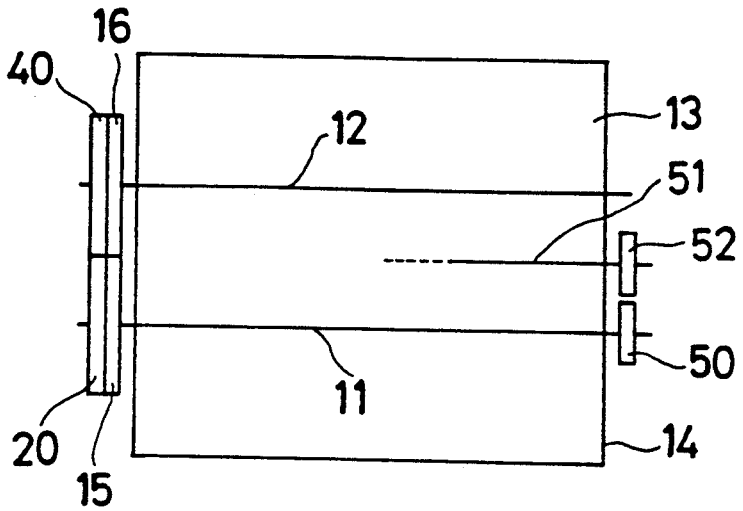
FIG. 3 is a schematic plan view of an engine which has the variable valve timing system.

Referring to FIGS. 1 and 2 wherein a variable valve timing system 10 is shown, cam-shafts 11,12 are rotatably supported on a cylinder head 13 of an engine 14 (shown in FIG. 3). Each of cam-shafts 11,12 drives each of intake and exhaust valves (not shown) via cams (not shown). The engine 14 is called a double overhead cam-shaft engine in general. In general, the number of cam-shafts included in an engine depends on the type of the engine, and is a multiple of two. A first gear 15 is rotatably supported on the cam-shaft 11 and has gear portions 15*a*,15*b*. A second gear 16 is fixed to the cam-shaft 12 via a pin 17 and bolt 18 and has a gear portion 16*a*. The second gear 16 is geared with the first gear 15 via the gear portions 16*a*,15*a*. The gear portions 15*a*,15*b* and 16*a* are outer gears.

A cover 20 is fixed to one end of the cam-shaft 11 via a pin 23 and bolt 24 and has gear portions 20*a*,20*b*. The gear portions 20*a* is an inner gear and the gear portions 20*b* is an outer gear. A cylindrical space 21 is formed between an outer surface 15*c* of the first gear 15 and an inner surface 20*c* of the cover 20. A cylindrical piston 22 is located in the cylindrical space 21 and can be moved therein horizontally. The cylindrical piston 22 has gear portions 22*a*,22*b*. The gear portions 22*a* is an outer gear and the gear portions 22*b* is an inner gear. The cylindrical piston 22 is geared with the first gear 15 via the gear portions 22*b*,15*b* and is geared with the cover 20 via the gear portions 22*a*,20*a*. Either the gear portions 15*b*,22*b* or the gear portions 20*a*,22*a* are operated as helical gear portions. A chamber (or room) 25 is formed on the left side (as viewed in FIG. 1) of the cylindrical piston 22 in the cylindrical space 21 and is in fluid communication with an oil pressure control means 30 (shown in FIG. 4) via a path (or passage, line) 26. A first means comprises the cover 20, the cylindrical piston 22 and the chamber 25 and is located on one end of the cam-shaft 11.

A third gear (rotating member) 40 is rotatably supported on the cam-shaft 12 via a projecting portion 16*b* of the second gear 16 and has gear portion 40*a*. The gear portions 40*a* is an outer gear. The third gear 40 is geared with the case 20 via the gear portion 40*a*,20*b*. An inner end of a coil spring (urging member) 41 is fixed to the projecting portion 16*b* and an outer end thereof is hanged on a pin 42 which is fixed to the third gear 40. A second means comprises the third gear 40 and the coil spring 41.

A first same phase group 60 comprises the cam-shaft 11 and case 20. A second same phase group 61 comprises the first gear 15, second gear 16 and cam-shaft 12.

FIG. 3 illustrates engine 14 having the variable valve timing system 10. An input pulley 50 is fixed to the other end of the cam-shaft 11 and is driven by a crank-shaft 51 of the engine 14 via an output pulley 52 and a belt (not shown).

Figure 4:
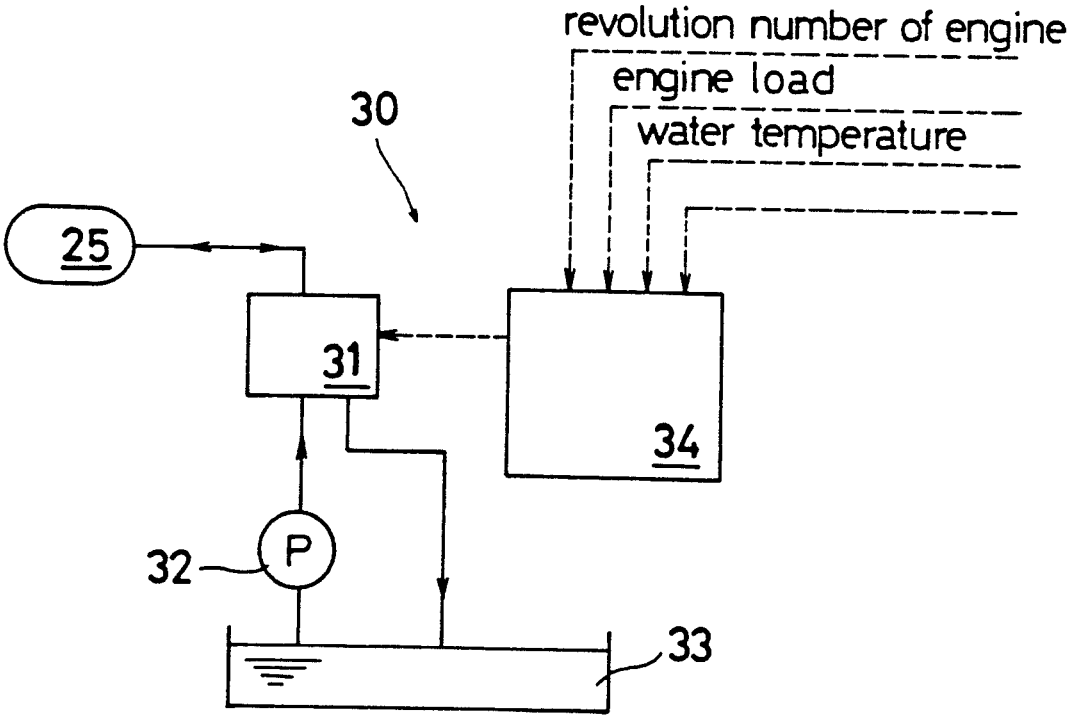
FIG. 4 is a circuit of an oil pressure control means of the variable valve timing system.
Figure 5:
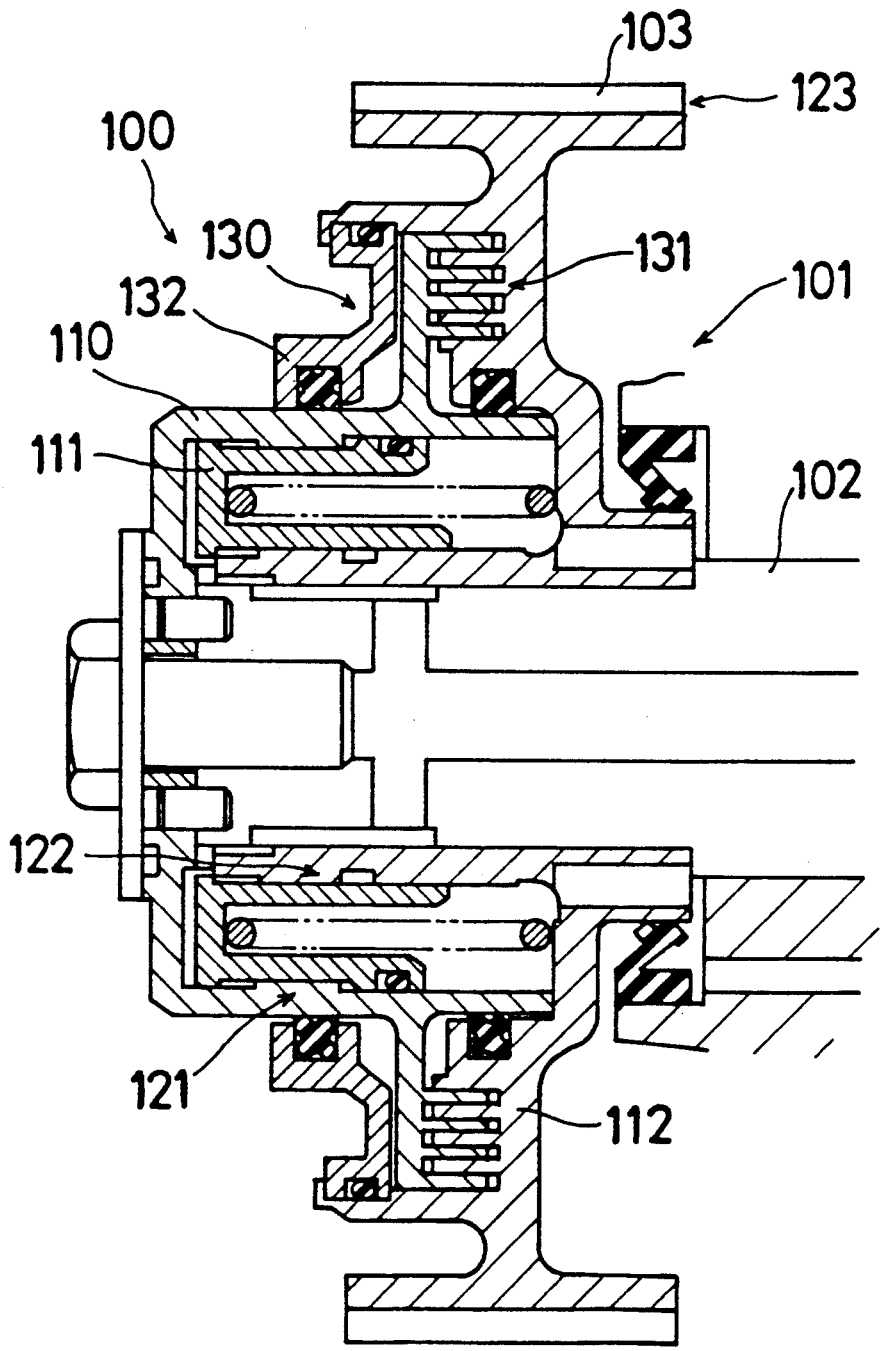
Fig. 5 (PRIOR ART)
FIG. 5 is cross-sectional view of a conventional variable valve timing system.

FIG. 4 illustrates the oil pressure control means 30. A valve means 31 supplies discharged oil pressure of an oil pump 32 to the chamber 25 and discharges oil pressure in the chamber 25 to an oil-pan 33 of the engine 14. This supplying and discharging of the valve means 31 are selectively controlled by a central processing unit 34. Signals representing the rate of rotation (rpm) of the engine 14, the engine load (ex. the opening ratio of the accelerator), the water (coolant) temperature of the engine 14 and the like are inputted into the central processing unit 34.

In the above-mentioned variable valve timing system 10, the second gear 16 is urged to a rotating direction D1 and the third gear 40 is urged to a rotating direction D2 by the coil spring 41. The direction D1 opposes to the direction D2. Therefore, the first gear 15 is urged to a rotating direction D3 and the case 20 is urged to a rotating direction D4. The direction D3 opposes to the direction D4. In addition, either the gear portions **15*b*,22*b* or the gear portions 20*a*,22*a* are operated as the helical gear portions, Therefore, the cylindrical piston 22 is urged to a leftward direction D5. A location of the cylindrical piston 22 shown in FIG. 1** is a first location which is a basic location.

When the central processing unit 34 controls the valve means 31 to completely discharge oil pressure in the chamber 25 to the oil-pan 33, the cylindrical piston 22 is kept in the first location. At this time, a capacity of the chamber 25 is minimum and there is no phase difference between the first same phase group 60 and second same phase group 61. That is, the second means rotates the cam-shaft 11 and the first gear 15 relatively to a second direction.

On the other hand, when the central processing unit 34 controls the valve means 31 to supply discharged oil pressure of an oil pump 32 to the chamber 25, the cylindrical piston 22 is moved to a rightward direction D6 against the urging force of the direction D5. After the rightward moving of the cylindrical piston 22 is finished, the cylindrical piston 22 is kept in a second location which is an advanced location. At this time, the capacity of the chamber 25 is maximum and there is a phase difference between the first same phase group 60 and second same phase group 61. That is, there is a phase difference between the cam-shaft 11 and cam-shaft 12. Further, that is, the first means rotates the cam-shaft 11 and the first gear 15 relatively to a first direction.

Irrespective of the location of the cylindrical gear 22, a rotating torque of the cam-shaft 11 is transmitted to the cam-shaft 12 via the case 20, cylindrical piston 22, first gear 15 and second gear 16.

A selection between the first location (basic location). Further, the cylindrical piston 22 can locate at optional locations between the first location and second location in such manner that the oil pressure control means 30 controls the oil pressure in the chamber 25 linearly according to the known method.

Backlashes between the gear portions **15*a* and 16*a*, between the gear portions 20*b* and 40*a*, between the gear portions 20*a* and 22*a* and between the gear portions 15*b* and 22*b* are substantially prevented by the coil spring 41**.

Obviously, numerous modifications and variations of the present invention are possible in light of the above teachings. It is therefore to be understood that within the scope of the appended claims, the invention may be practiced otherwise than as specifically described herein.

What is claimed is:

1. A variable valve timing system in an engine having first and second cam-shafts comprising:

a first gear rotatably supported on the first cam-shaft;

a second gear fixed to the second cam-shaft, and geared with the first gear to transmit torque to the second cam-shaft;

first means for transmitting torque from the first cam-shaft to the first gear, and for rotating the first gear in a first direction toward a first position, the first means being located on one end of the first cam-shaft; and second means for rotating the first gear in a second direction opposite the first direction, toward a second position, the second means being located on one end of the second cam-shaft.

2. A variable valve timing system as set forth in claim 1, wherein the first means comprises a cover fixed to the one end of the first cam-shaft and a piston geared with the first gear and the cover, and the second means comprises an urging member and a rotating member supported rotatably on the second cam-shaft rotatably and geared with the cover, one end of the urging member being fixed to the second gear and the other end of the urging member being fixed to the rotating member.

3. A variable valve timing system in an engine having first and second cam-shafts comprising:

a first gear rotatably supported on the first cam-shaft;

a second gear fixed to the second cam-shaft, and geared with the first gear to transmit torque to the second cam-shaft;

first means for transmitting torque from the first cam-shaft to the first gear, and for rotating the first gear in a first direction toward a first position, the first means being located on one end of the first cam-shaft, the first means comprising a cover fixed to the one end of the first cam-shaft and a piston geared with the first gear and the cover; and second means for rotating the first gear in a second direction toward a second position, the second means being located on one end of the second cam-shaft, the second means comprising an urging member and a rotating member rotatably supported on the second cam-shaft, one end of the urging member being fixed to the second gear and the other end of the urging member being fixed to the rotating member.

4. A variable valve timing system in an engine having first and second cam-shafts as set forth in claim 3 further comprising:

oil pressure control means for moving the piston to cause the first gear to rotate toward the first position; and an input pulley fixed to the other end of the first cam-shaft and driven by a crank-shaft of the engine.

* * * * *